United States Patent [19]

Steidinger

[11] Patent Number: 4,889,278

[45] Date of Patent: Dec. 26, 1989

[54] METHOD OF PRODUCING A PRINTED MAILER FORM

[75] Inventor: Donald J. Steidinger, Barrington, Ill.

[73] Assignee: Wallace Computer Services, Inc., Hillside, Ill.

[21] Appl. No.: 190,408

[22] Filed: May 5, 1988

Related U.S. Application Data

[63] Continuation-in-part of Ser. No. 919,459, Oct. 16, 1986, Pat. No. 4,754,915.

[51] Int. Cl.[4] ..... B65D 27/00

[52] U.S. Cl. ..... 229/92.1; 229/92; 229/73

[58] Field of Search ..... 229/92.7, 92.1, 73, 229/69, 70, 92, 92.3

[56] References Cited

U.S. PATENT DOCUMENTS

| | | | |
|---|---|---|---|
| 3,143,279 | 8/1964 | Black | 229/73 |
| 3,229,893 | 1/1966 | Stein | 229/68 |
| 3,303,987 | 2/1967 | Caine | 229/92.8 |
| 3,820,447 | 6/1974 | Genpron et al. | 229/73 |
| 3,863,835 | 2/1975 | Gendron | 229/69 |
| 3,995,808 | 12/1976 | Kehoe | 229/73 |
| 4,575,121 | 3/1986 | Conti | 229/69 |
| 4,705,298 | 11/1987 | Van Malderghem | 229/73 |
| 4,706,878 | 11/1987 | Lubotta et al. | 229/92.3 |
| 4,728,027 | 3/1988 | Steidinger | 229/69 |

FOREIGN PATENT DOCUMENTS

| | | |
|---|---|---|
| 0255135 | 6/1987 | European Pat. Off. . |
| 0251580 | 1/1988 | European Pat. Off. . |
| 2281284 | 3/1976 | France . |
| 534588 | 3/1941 | United Kingdom . |
| 2183203 | 6/1987 | United Kingdom . |

*Primary Examiner*—Willis Little

*Attorney, Agent, or Firm*—Tilton, Fallon, Lungmus & Chestnut

[57] ABSTRACT

A method of producing a mailer form which has been printed at by laser, jet ink, etc. wherein a single sheet or web is adapted by the provision of a plurality of fold lines to have variable information printed on both the front panel ad the message panel by folding to dispose the message panel interiorily while the mailer face panel is positioned exteriorily so the message panel is enclosed by the mailer face panel, mailer back panel and flap panel, and by virtue of side tear off stubs the mailer can be readily opened for access to the message panel by the recipient.

19 Claims, 3 Drawing Sheets

FIG. 1
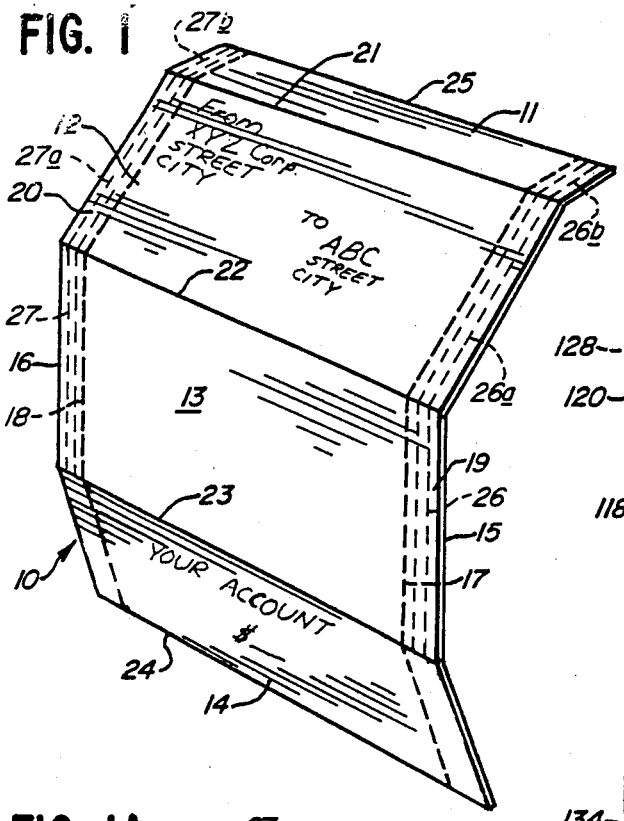
FIG. 2
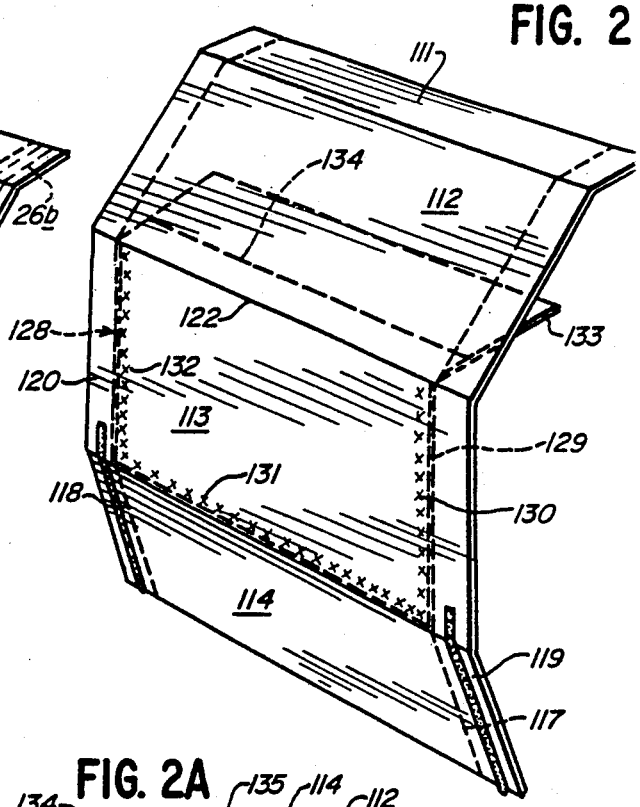
FIG. 1A
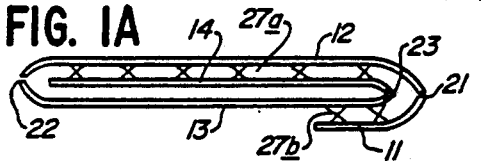
FIG. 2A
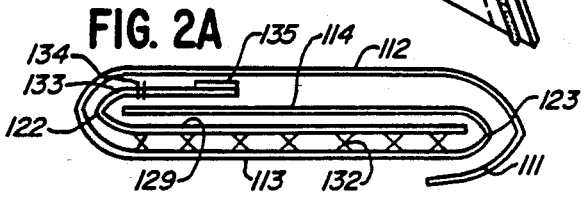
FIG. 2B
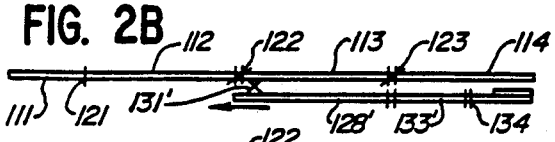
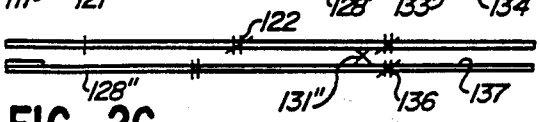
FIG. 2C
FIG. 3
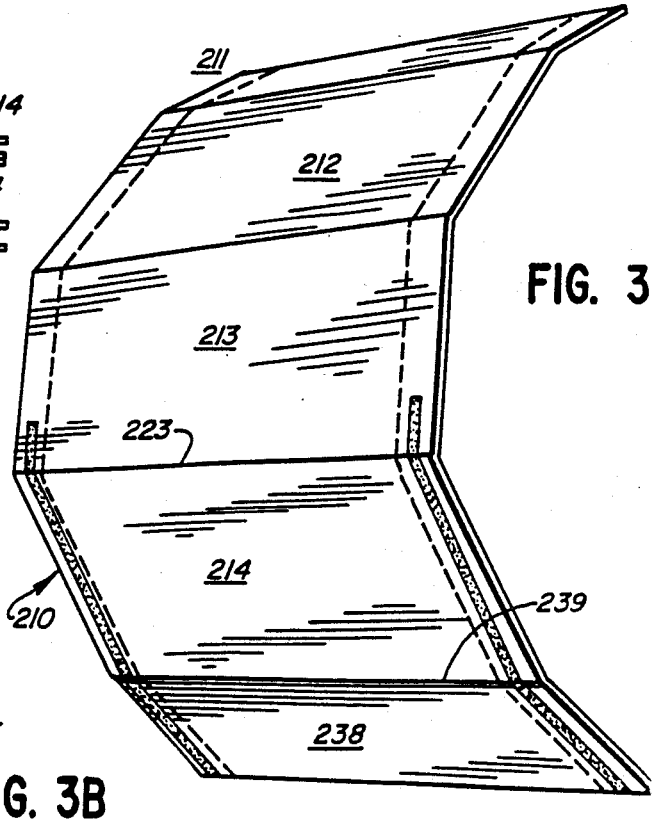
FIG. 3A
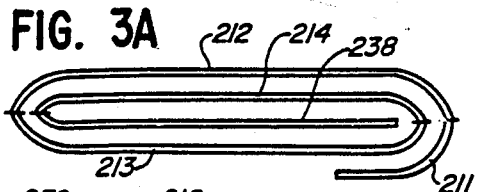
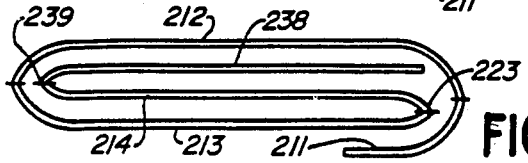
FIG. 3B FIG. 4
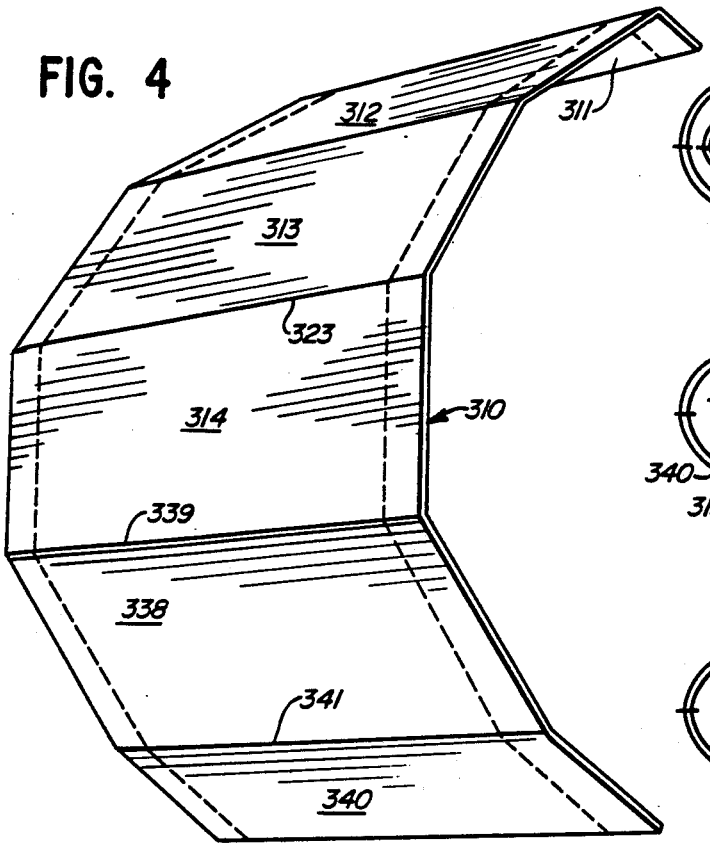
FIG. 4A
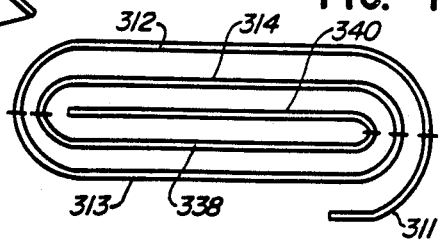
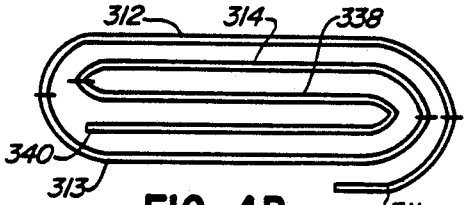
FIG. 4B
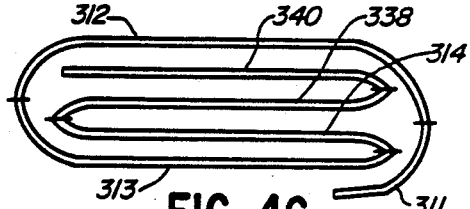
FIG. 4C
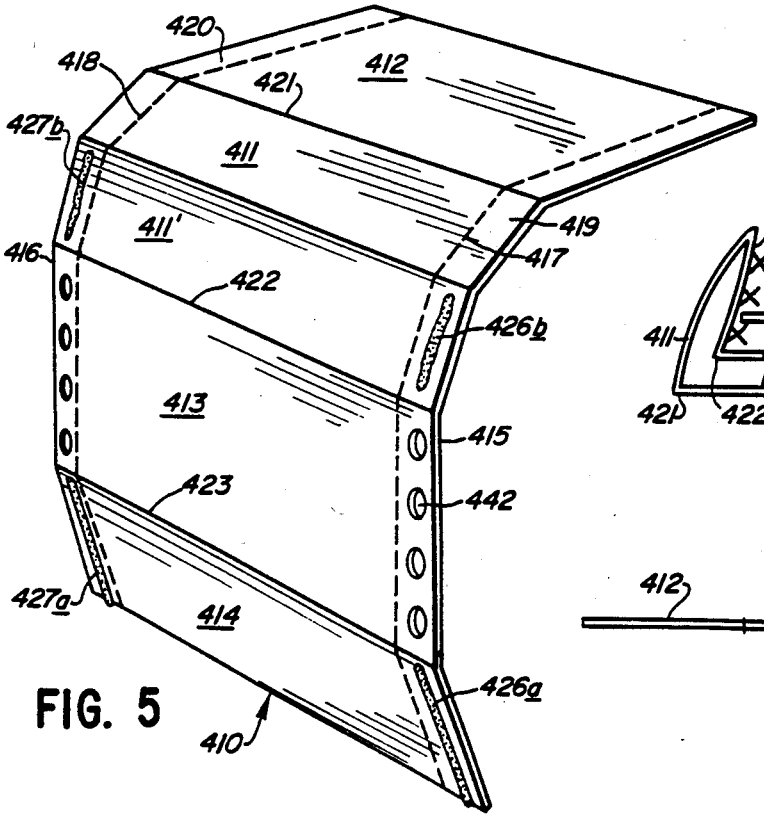
FIG. 5
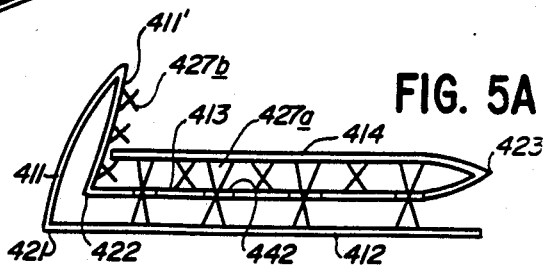
FIG. 5A
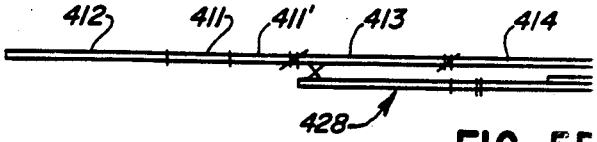
FIG. 5E

METHOD OF PRODUCING A PRINTED MAILER FORM

This application is a continuation-in-part of my copending application Ser. No. 919,459 filed Oct. 16, 1986, now Patent No. 4,754,915.

BACKGROUND AND SUMMARY OF INVENTION

This invention relates to a method of producing a printed and, more particularly, a single message-ply mailer form printed as by laser printing, ink jet printing, etc.

There is a need for a mailer form in business systems and promotional applications that can be used with non-impact and particularly laser type computer printers.

The mailer forms exemplified by my earlier patents are all designed for impact type computer printers where an image on an outside office ply also makes an image on the face of the mailer envelope and on plies already inside the mailer envelope. These mailers are not suited for use with non-impact computer printers or where an original computer printed image is desired on the message copy of the mailer.

The mailers that are subject of this invention are computer printed where they are essentially in the form of a single ply. This ply is then folded and glued in a way that will achieve several important objectives:

First, the mailer can be a single ply form without the need for die cut windows, window patching or glue patterns. This results in a low cost, easy to manufacture mailer.

Second, the absence of exposed glue patterns, rough edges of a window die cut, and loose edges of window patches results in a form that gives trouble free feeding and printing in the computer, particularly on laser printers.

The face of the envelope, back of the envelope, message area and even the flap are in position to receive computer print-out information. After folding, all the message areas are protected from handling wear and tear and for security of the information by portions of the mailer that are later to be discarded by the recipient.

Third, after computer print-out, the mailer can be folded conveniently on readily available paper folding equipment thus avoiding the need for specialized equipment.

Fourth, the mailer is held in the folded condition for mailing by simple glue lines that are applied on the folder. It is also possible to provide glue patterns on the mailer form initially and to activate these glue patterns by means of moisture, heat or pressure.

Fifth, the folded mailer completely encloses the message portion so that it is secure from prying eyes.

Sixth, the folded mailer is easily opened by the recipient by removing a perforated stub at each end. It is also easy to remove and dispose of the non message portions of the mailer that are to be discarded.

The inventive mailer method includes the provision of a flap panel, a face of the mailer panel, a back of the mailer panel, a message portion including one or more panels and two stub end portions. The single ply form can be printed with fixed information before the form is computer printed. An interior cross perforation may be provided to facilitate the eventual separation of the message panels from the other portions which are to be discarded by the recipient. A vertical perforation near each size enables the recipient to remove the two end stubs in order to open the mailer. This is provided most advantageously after folding to insure alignment of the perforations. The invention also provides an advantageous return envelope construction. Other objects and advantages of the invention may be seen in the details of the ensuing specification.

The invention is described in conjunction with the accompanying drawing, in which FIG. 1 is a perspective view of a mailer produced according to the teachings of this invention;

FIG. 1A is a side elevational view of the folded mailer of FIG. 1;

FIG. 2 is a perspective view of the folded mailer of FIG. 1;

FIG. 2A is a side elevational view of the mailer of FIG. 2 but in folded condition;

FIG. 2B is a side elevational view essentially schematic of the mailer of FIG. 2 but with a modified form of return envelope.

FIG. 2C is a view similar to FIGS. 2B but of another form of return envelope;

FIG. 3 is a perspective view of another form of mailer, this including two message panels;

FIGS. 3A and 3B are elevational view showing the mailer of FIG. 3 in two different fold configurations;

FIG. 4 is a perspective view of a five panel mailer;

FIGS. 4A, 4B and 4C are side elevational views of three different fold configurations useful in connection with the mailer of FIG. 4;

FIG. 5 is a perspective view of a mailer having a different type of flap configuration from that seen in FIG. 1 but also embodying three basic panels;

FIG. 5A is a side elevational view of the mailer of FIG. 5 in folded form;

FIG. 5B is a side elevational view essentially schematic of the mailer of FIG. 5 but equipped with a return envelope.

DETAILED DESCRIPTION

Figure 6:
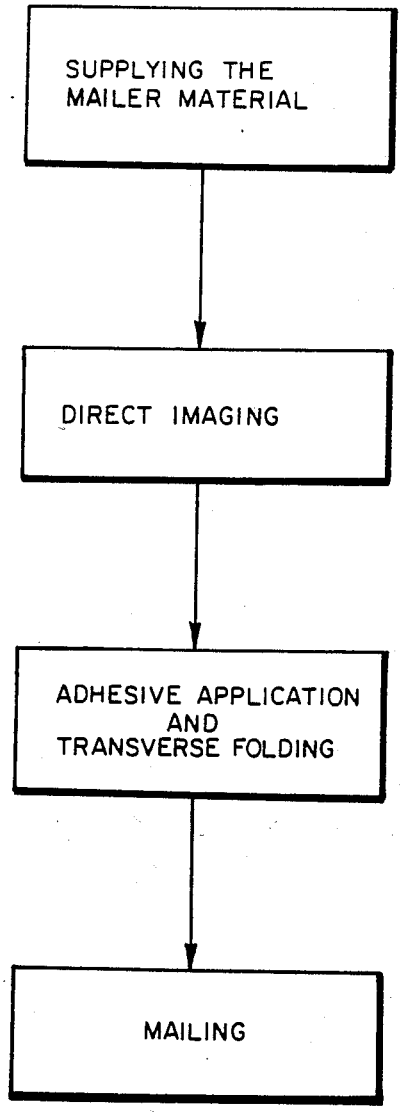
FIG. 6 is a schematic view depicting the method steps of the invention.

In the illustration given and with reference first to FIG. 1, the numeral 10 designates generally a mailer printed by non-impact printing which is constructed according to the teachings of this invention. It will be appreciated, however, that the inventive mailer can serve when original computer printing is used for the address and message. This not only includes non-impact printers but also impact printers—as where an original printout is desired, as on checks, for instance. The mailer 10 is a unitary paper sheet and is equipped with a plurality of fold lines dividing the sheet into four panels. The uppermost panel 11 ultimately becomes the flap of the mailer when it is sent out to the recipient.

Positioned immediately therebelow (in the illustration given) is the panel 12 which becomes the face of the mailer, i.e., the portion to be equipped with the addressee information. This normally varies form mailer to mailer.

Still proceeding downwardly in FIG. 1, the panel designated 13 ultimately becomes the back of the mailer when it is being sent out. The back of the mailer 13 and flap 11 are available for computer variable information such as customer account number, return address, promotional message, etc. Lastly, the bottom panel 14 will become the message panel on which other variable information will be printed—this along with the panel 12 which is the face of the mailer and it will be seen that the information to be imprinted thereon will occur on the same face of both panels 12 and 14.

The mailer as illustrated in FIG. 1 has two side edge portions 15 and 16 respectively and adjacent to but slightly inboard thereof are lines of perforation as at 17 and 18 defining tear off stubs 19 and 20.

Extending perpendicularly to the lines of perforation 17 and 18 are a plurality of transversely extending fold lines as at 21, 22 and 23. Fold lines 21 and 22 define the mailer face panel 12. Fold lines 22 and 23 define the mailer back panel 13. Fold line 23 with the sheet edge 24 define the message panel 14, and fold line 21 along with sheet edge 25 define the flap panel 11.

Operation Generally

The sheet 10 can be processed through a computer printer either in discreet form as shown or as part of a continuous web, with transverse separation occurring thereafter.

As seen in FIG. 6, the initial step consists of supplying the mailer material. As just pointed out, this can be in the form of a continuous web, as from a parent roll or from a zig-zag folded stack. Either a supply is useful currently with an IBM 3800 laser printer. Alternatively, a stack of cut sheets are useful currently with a Xerox 9700 laser printer.

Thereafter the mailer material, continuous or discreet, is conducted to the computer printer for printing. The current state of the art provides such printing on only one side of the sheet. However, such printing could be applied to both sides—with the proviso that the variable information be confined to panels 12 and 14 as illustrated in FIG. 1.

Thereafter, the mailer material is conducted to a folder wherein the fold lines 21, 22 and 23 are applied. Currently available folders also have the capability of adhesive application as at 26 and 27. This results in a web product folded and adhesively united as illustrated in FIG. 1A. Applying adhesive after printing insures that a uniform thickness web is processed through the printer and that the glue is not activated by the heating the fusing section of a laser printer or that glue does not come in contact with the delicate printing drum.

Thereafter, and advantageously according to the preferred practice of the invention, the vertical or longitudinal perforation is performed as at 17 and 18. In addition to providing an unperforated sheet for processing through the printer, this subsequent step insures that all of the panels have their perforations exactly aligned. It will be appreciated that a slight angle in the fold lines will result in perforations that are skewed relative to each other in different panels. This makes it difficult to tear off the stubs to open the mailer.

Summarizing, the mailer 10 is normally computer imprinted in the panels 12 and 14 with variable information relating to the addressee and the particular message, respectively. Other panels are also available for computer imprinting.

After computer printout, the mailer is folded as illustrated in FIG. 1A. Referring now to FIG. 1A, the message panel 14 is seen in the central portion of that figure and is defined at one edge by the fold line 23. Positioned under the message panel 14 is the mailer back panel 13—by folding along the fold line 23. Thereafter, the face 12 of the mailer is positioned over the message panel 14 by folding around the fold line 22. Lastly, the flap 11 is positioned over the mailer back panel 13 by folding around the fold line 21.

Incident to this folding, adhesive is advantageously applied to the rear face of the tear off stubs 19 and 20 of the panels 11–13)as at 26 and 27 in FIG. 1. This results in the front face of the message panel 14 being adhered along its sides to the rear face of the front panel 12 as at *26a* and *27a*. The rear face of the back panel 13 is adhered to the back face of the message panel 14. It also results in the flap panel 11 being adhered to the back of the mailer as at *26b* and *27b*. Thus, a completely side-sealed envelope results. Alternatively, the adhesive can be placed on the front face as in FIGS. 2 and 3 but I prefer to place it on the rear face because it is more easily accomplished in the folder and also possible to have a completely glued end stub. Also, glue on the front face may leave some panel faces unglued as can be appreciated from FIG. 2 —but only normally unconfidential panels being relatively accessible.

When the mailer is received by the recipient all he or she has to do is to tear off the two tear off stubs 19 and 20 whereupon the mailer can be unfolded. Normally, I provide a line of perforation along the fold line 23 so as to permit the message panel to be readily separated from the remainder of the mailer. This is particularly advantageous when a return envelope is provided within the mailer as can be seen in FIG. 2.

In FIG. 2, the numerals designating parts identical to those in FIG. 1 are given the same numeral but with the addition of 100. Hence, the flap panel is 111, the mailer front 112, the back 113 and the message panel 114. In like fashion, the tear off stubs are 119 and 120. Further, both the fold lines 122 and 123 include lines of perforation which permit not only detachment of the message panel 114 from the mailer back 113 but also detachment of the face of the mailer 112 from the back of the mailer 113. This results in the provision of the return envelope generally designated 128 (see also FIG. 2A).

The return envelope 128 is developed by using a patch or ply of paper secured to the rear or second face of the mailer, i.e., the side opposite to that receiving the computer printing. This advantageously is positioned between the stub forming perforations 117 and 118 and consists of two portions. The first portion 129 is secured to the back panel 113 by gluing along three sides as at 130, 131, and 132. The second portion 133 is not adhesively secured but underlies the mailer front 112 and is provided with a line of potential folding as at 134. Thus, it is possible for the recipient to return the message panel 114 by only folding the same once.

In use, the recipient detaches the return envelope which includes the mailer back 113 and the two portions 129 and 133 from the remainder of the mailer—by tearing along the lines of perforation 122 and 123. After insertion of the message panel 114, check, or other information piece, the return envelope 128 is closed by folding along the line 134 using adhesive that has been previously applied as at 135. This may be the remoistenable variety and the return envelope is now ready for mailing.

Two variations of the return envelope are available as presented in FIGS. 2B and 2C. In FIG. 2B, a return envelope 128' is provided which is again attached to the back panel but with the glue line 131' reoriented so that when the mailer is processed through the computer in the direction of the arrow applied to FIG. 2B, there will be no possibility of the flap part 133' being caught.

In FIG. 2B, I have employed a single transverse line as at 121 to represent a fold line and a double transverse line as at 134 to represent a perforation lie with strong bonds so that it is readily folded but not too easily broken. The third form of designation is a double line with a lash across as at 122 and 123 to indicate a line of perforation with very weak bonds so that separation is easily achieved.

In some instances, it may be advantageous to have the return envelope of the same length as the mailer, i.e., coextensive therewith and this is illustrated at 128" in FIG. 2C. This again is secured to the rear panel 113 by means of a line of transverse glue as at 131". I provide another line of perforation with weak bonds as at 136 for easy detachment of a portion of the second web—which provides the return envelope —but which is not needed with the return envelope is used. This additional portion 137 seen at the extreme right of FIG. 2C may carry advertising information, instructions, or the like.

Turning now to FIG. 3, a mailer form generally designated 210 is provided which is identical in most respects to that seen in FIG. 1—but with the exception of providing an additional message panel 238. The first and second message panels 214 and 238 are adapted to be separated from the remainder of the mailer by detachment along the line of perforation 223. This then provides the recipient with panels 214 and 238 which are separated by a fold line 239.

With the construction of FIG. 3, two folding configurations are available. In FIG. 3A I illustrate what could be considered a "continuous rollover" fold—where the mailer is essentially folded on itself as one would wind an element.

The other folding configuration is illustrated in FIG. 3B which embodies a form of "zig-zag" folding. In FIG. 3B, the message panel 238 is on top of the first message panel 214. Below the panel 214 is the back panel 213. Completing the mailer assembly is the front panel 212 and the flap 211.

In FIG. 3A, the second or bottom-most message panel 238 underlies the first message panel 214 after which the configuration is the same.

In FIG. 4 I illustrate a mailer 310 which has three message panels 314, 338 and 340. The line 323 separating the first message panel from the mailer back is advantageously a line of perforation whereas the line 339 between the first and second message panels 314 and 338 is a fold line—as is the line 341 between the second and third message panels 338 and 340.

With three message panels, three folding variations are possible and these are illustrated in FIGS. 4A, 4B and 4C.

In FIG. 4A, the continuous rollover form characteristic of FIG. 3A is employed on the message panels.

In FIG. 4B, a combination of the rollover and zig-zag procedure is employed whereas in FIG. 4C the folding is of the zig-zag type on the message panels.

In the version of the invention presented in FIG. 5, I am able to provide two message panels. In the illustration given in FIG. 5 the face of the mailer is designated 412 and proceeding downwardly first and second flap portions 411 and 411' are next encountered. The fourth panel down is designated by the numeral 413 and is available for a message imprinting, the same as is the back panel 414. Thus, I am able to use the mailer back panel as a second message panel.

By the provision of two intermediate flap panels 411 and 411', I am able to provide the two message panels 413 and 414 while still achieving a confinement or enclosing of the message panels within the mailer. This can be appreciated from a consideration of FIG. 5A. There it will be seen that the rear of the message panel 414 now becomes the back of the folded mailer and next in proceeding downwardly is the message panel 413. The message panels 413 ad 414 are separated by a fold line 423 which can also be seen in FIG. 5. The message panel 413 is also defined by a fold line 422 which is adjacent the flap 411'. The flaps 411 and 411' are folded on themselves as can be appreciated from the left hand portion of FIG. 5A and folded behind the two message panels 413 and 414. The face panel 412 is folded under the message panel 413. The face panel 412 is defined in part by the fold line 421.

Again, the unitary sheet is equipped with lines of perforation 417 and 418 adjacent the longitudinal edges 415 and 416 respectively. This develops the tear off stubs 419 and 420.

Adhesive is provided as at **426*a* and 427*a* analogous to that found in the embodiment of FIG. 1. However, the portion of the glue stripe at 426*b* and 427B is positioned differently from that in FIG. 1, being on the front face of the second flap 411'**.

By reference to FIG. 5A, it will be seen that the first glue line **427*a* is effective to adhere together the sides of the message panels 414 and 413. Then, by virtue of the glue provided at 427*b*, the flap 411' is adapted to be secured to the unprinted face of the second message panel 411. The sides of the front panel 412—in the stub portion—are secured to the remainder of the mailer by the adhesive 426*a* and 427*a* extending through the holes 442 in the first message panel 413**.

In FIG. 5B I show a modified form of the mailer 410 which includes a return envelope 428. This showing is analogous to that found in FIG. 2B.

While in the foregoing specification a detailed description of an embodiment of the invention has been set down for the purpose of illustration, many variations in the details hereingiven may be made by those skilled in the art without departing from the spirit and scope of the invention.

I claim:

1. A method of producing a mailer having variable information thereon comprising advancing a stream of elongated forms into a computer printer, each said form being rectangular, windowless and continuous throughout its entire area and having two short sides and two long sides, said advancing being parallel to said long sides applying variable information at longitudinally spaced-apart areas on one face only of each form to provide addressee information in one area and message information in a second area, applying adhesive to a portion of each form adjacent said long sides, each said form being longitudinally perforated inwardly of each area of adhesive application to provide tear-off stubs at each form long side, folding each form on itself parallel to said short sides at least three times to provide four panels with one panel separating the message information area from the addressee information area, said folding being effective to dispose the message information interiorly and the addressee information exteriorly of the folded form,

2. The method of claim 1 in which said perforation is performed after folding.

3. The method of claim 1 in which said stream consists of a plurality of individual forms.

4. The method of claim 1 in which said stream consists of a continuous web of forms.

5. A method of developing a mailer with computer entered information comprising:

advancing a continuous web comprising a continuous series of windowless mailers each having a plurality of panels through a computer printer, and printing the computer entered information on at least some of the spaced apart panels on the front surface of the mailer, and bursting the series of mailers into individual mailers, and applying adhesive in at least a portion of the length of the longitudinal edges of the mailer, said mailer being adapted to be longitudinally perforated adjacent said longitudinal edges and inboard of the adhesive to provide removal stubs, making a first fold perpendicular to said longitudinal edge to place a message panel with the computer printed side facing outwardly, underlying the next adjacent panel forming the envelope back, making a second fold between a successive adjacent panel which forms the envelope front and the panel with the envelope back such that the message panel is covered by the envelope front panel, and so that the message panel is between the envelope front and back panels and the envelope front panel has the computer entered addressee information facing outwardly, and making a third fold between a still further adjacent panel which forms the envelope flap and the panel forming the envelope front so that the envelope flap overlies the envelope back to secure the confidentiality of the message panel inside the envelope.

6. The method of claim 5 in which two message panels are folded inside the envelope of a five panel mailer.

7. The method of claim 5 in which three message panels, are folded inside the envelope of a six panel mailer.

8. The method of claim 5 in which each said mailer is longitudinally perforated prior to folding.

9. The method of claim 5 in which each said mailer is longitudinally perforated subsequent to folding.

10. The method of claim 5 in which a return envelope is included in said folded mailer.

11. The method of claim 10 in which a second ply is adhesively attached to said mailer on the other surface thereof.

12. The method of claim 5 wherein the panel between said spaced apart panels is a rear panel for the outgoing mailer, and printing return address information on said rear panel.

13. The method of claim 5 in which said adhesive applying step employs a heat-activatable glue, and heating said glue after folding.

14. The method of claim 5 in which said adhesive applying step employs a stick-to-itself glue.

15. The method of claim 5 in which said stubs are equipped with adhesive on the front face of the mailer.

16. The method of claim 5 in which said stubs are equipped with adhesive on the rear face of the mailer.

17. A method of producing a mailer having variable information thereon comprising advancing a stream of elongated forms into a computer printer, each said form being rectangular, windowless and continuous throughout its entire area and having two short sides and two long sides, said advancing being parallel to said long sides, applying variable information at longitudinally spaced-apart areas on one face only of each form to provide addressee information in one area and message information in a second area, each said form being longitudinally perforated inwardly of each area of adhesive application to provide tear-off stubs at each form long side, folding each form on itself parallel to said short sides two times to provide three panels with one panel separating the message information area from the addressee information area, said folding being effective to dispose the message information interiorly and the addressee information exteriorly of the folded form, and folding each form on itself a third time to provide a fourth panel adjacent the panel carrying the addressee information, said fourth panel constituting an envelope flap overlying said separating panel to secure the confidentiality of the message panel inside the envelope.

18. The method of claim 17 in which said perforation is performed after folding.

19. The method of claim 17 in which a separate panel of web material is applied to each web form to provide a return envelope.

* * * * *